United States Patent [19]

Damico

[11] Patent Number: 4,922,836

[45] Date of Patent: May 8, 1990

[54] LEAD SCREW SUPPORT MECHANISM FOR AN OVERBED TABLE

[75] Inventor: Frank M. Damico, Neenah, Wis.

[73] Assignee: Thill, Inc., Oshkosh, Wis.

[21] Appl. No.: 278,598

[22] Filed: Dec. 1, 1988

[51] Int. Cl.[5] ..... A47B 7/00

[52] U.S. Cl. ..... 108/144; 108/146; 248/188.4

[58] Field of Search ..... 108/144, 146, 106, 150; 248/188.2, 188.4, 162.1, 297.1, 123.1

[56] References Cited

U.S. PATENT DOCUMENTS

| | | | |
|---|---|---|---|
| 430,392 | 6/1890 | Maschmeyer . | |
| 478,840 | 7/1892 | Biggs et al. . | |
| 720,549 | 2/1903 | Adler . | |
| 2,010,292 | 8/1935 | Campbell . | |
| 3,194,107 | 7/1965 | Linden et al. | 108/146 |
| 3,481,286 | 12/1969 | Mar et al. | 108/144 |
| 3,560,033 | 2/1971 | Barkus . | |
| 3,715,997 | 2/1973 | Barth . | |
| 3,741,514 | 6/1973 | Snurr . | |
| 3,807,574 | 4/1974 | Lanza . | |
| 3,890,907 | 6/1975 | Peterson | 108/144 X |
| 3,905,311 | 9/1975 | Capentier | 108/149 X |
| 3,999,492 | 12/1976 | Emrick | 108/146 X |
| 4,033,543 | 7/1977 | Ponzellini . | |
| 4,195,578 | 4/1980 | Benoit et al. | 108/144 |
| 4,318,526 | 3/1982 | Werner . | |
| 4,601,246 | 7/1986 | Damico | 108/146 X |
| 4,747,353 | 5/1988 | Watt | 108/146 |
| 4,763,864 | 8/1988 | Healy | 248/162.1 X |

FOREIGN PATENT DOCUMENTS

| | | | |
|---|---|---|---|
| 262549 | 6/1968 | Austria . | |
| 1449684 | 11/1966 | France . | |
| 2133683 | 8/1984 | United Kingdom | 108/144 |

*Primary Examiner*—Jose V. Chen

*Attorney, Agent, or Firm*—Andrus, Sceales, Starke & Sawall

[57] ABSTRACT

An overbed table is provided with a linear positioning mechanism for fixing the height of the table relative to the base. An upper outer column depends from the underside of the table, and a lower inner column is received within the upper outer column. In this manner, spillage of any liquids onto the support for the overbed table drips single fashion past the joint between the columns. The linear positioning mechanism incorporates a high lead screw which is rotatably mounted to the overbed table within the upper outer column. A fixed nut is attached to the upper end of the inner column, and receives the threads of the high lead screw. Up-down movement of the overbed table causes rotation of the high lead screw within the fixed nut. A spring clutch mechanism is provided for selectively preventing and allowing rotation of the high lead screw when a downward force is applied to the table. When rotation of the lead screw is prevented, downward movement of the overbed table is thus prevented. Upon release of the clutch so as to allow rotation of the lead screw, the overbed table can be moved downward to a desired elevation. An upward force applied to the table allows the table to be moved upward without actuation of the clutch mechanism.

26 Claims, 2 Drawing Sheets

LEAD SCREW SUPPORT MECHANISM FOR AN OVERBED TABLE

BACKGROUND AND SUMMARY

This invention relates to a linear positioning mechanism, and more particularly to a positioning mechanism for use with an overbed table such as is used in a hospital, nursing home or the like.

An overbed table typically has a wheeled base supporting a lower pedestal column to which an upper column is movably mounted. The upper column is typically connected at its upper end to the underside of the overbed table. The base is wheeled under the bed, with the table extending over a patient lying or sitting on the bed. The upper column is movable on the lower column for adjusting the vertical height of the table, and a latching mechanism including a manually operable lever is provided for maintaining the table at a desired elevation. As a safety feature, the latching mechanism is designed to allow upward movement of the table top without operation of the manually operable lever.

Various mechanisms are known for providing vertical positioning of an overbed table. One such mechanism is disclosed in U.S. Pat. No. 4,601,246, owned by the assignee of the present invention. The structure shown in this patent provides a lower outer column in which the upper column is telescopically mounted. A shelf is formed by the upper end of the lower column, with a gap between the upper and lower columns. With this construction, it is possible for spilled liquids to flow through the gap between the upper and lower columns and into the interior of the lower column. The presence of liquids in the interior of the lower column can result in problems in operation of the assembly, and it is often difficult to clean the inside of the lower column to remove such contaminants. This problem is one which has been recognized by those in the health care field. A solution to this problem is provided by installing an upper outer sleeve concentric with the upper column to prevent entry of liquids into the interior of the lower column.

A structure which avoids the above-noted problem is shown in U.S. Pat. No. 3,890,907. A drawback to the construction shown in this patent, however, is that it incorporates a rather complicated positioning mechanism including cables, pulleys, drums, cable retainers, shafts, springs and other structural elements.

It is an object of the present invention to provide a relatively simple linear positioning mechanism for selectively fixing the position of a first member relative to a second member. It is a further object of the invention to provide a support mechanism for an overbed table which incorporates such a linear positioning mechanism, and which employs a design incorporating an upper outer column so as to prevent contamination of the interior of the support. In accordance with the invention, a linear positioning apparatus for selectively fixing the position of a first member, such as an overbed table, relative to a second member, such as a base, includes an elongated threaded member interconnected with one of the first or second members, and a threaded nut engageable with the threaded member and interconnected with the other of the first or second members. The elongated threaded member may comprise a high lead screw. The lead screw and the nut are interconnected so that movement of the overbed table relative to the pedestal base causes relative movement between the lead screw and the nut. A selectively engageable clutch means is associated with the apparatus for selectively allowing and preventing relative movement of the nut and lead screw, and thereby selectively allowing and preventing relative movement between the overbed table and the base. In one embodiment, the lead screw is interconnected with the overbed table, and its position is fixed relative to the upper column. The threaded nut is fixed to the upper end of the lower column so that rotation of the nut is prevented. Upward and downward movement of the overbed table relative to the base causes rotation of the lead screw as it moves through the threaded nut. The clutch mechanism is engageable with the lead screw for selectively preventing and allowing its rotation in response to a downward force applied to the table. When the clutch mechanism is released, a downward force on the table causes the table to move relative to the base, and the lead screw to rotate within the nut. When the clutch mechanism is engaged, so that rotation of the lead screw in one direction is prevented, the overbed table may not be moved downwardly relative to the base.

In one embodiment, the clutch mechanism is a unidirectional spring clutch in which a first clutch member is affixed to the upper column, and a second clutch member is mounted to the lead screw. A spring is wrapped around the first and second clutch members, and is biased towards a normal position in which it couples the first and second clutch members together by engaging the outer surfaces of each clutch member. A release mechanism is provided for selectively moving the spring out of engagement with the first and second clutch members so as to allow relative movement therebetween. With the described clutch mechanism, it is not necessary to operate the release mechanism in order to effect upward movement of the table. When it is desired to lower the table, the release mechanism is actuated so as to move the clutch spring out of engagement with the first and second clutch members and a downward force is applied to the table, resulting in rotation of the lead screw within the nut. Upon release of the release mechanism, the spring returns to its normal condition so as to engage the outer surfaces of the first and second clutch members and thereby prevent rotation of the lead screw, thereby fixing the table at the desired elevation.

The invention provides a simple and efficient design for a linear positioning mechanism for an assembly such as an overbed table. The apparatus of the invention is easily constructed, and provides a quiet and easily operated support for an overbed table.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
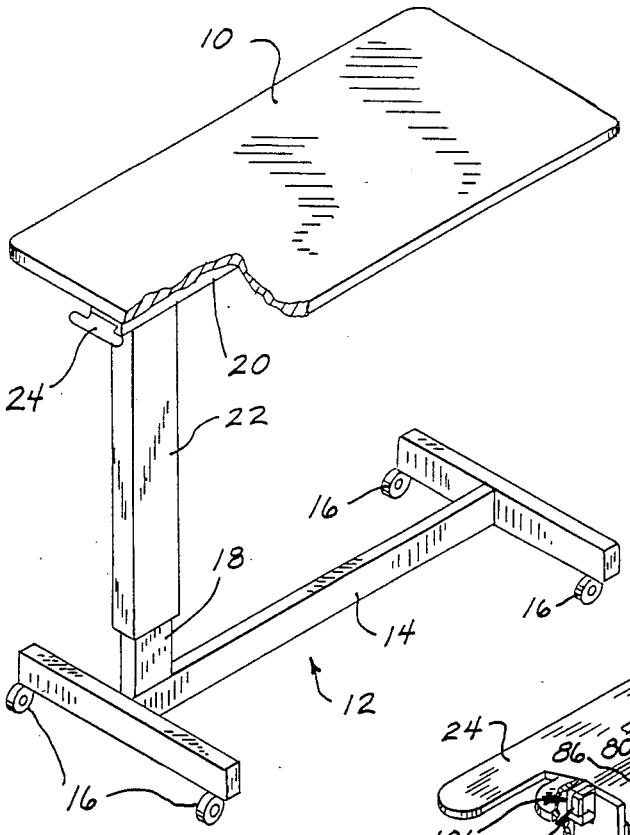
FIG. 1 is an isometric illustration of an overbed table incorporating the support mechanism of the invention.

With reference to FIG. 1, an overbed table 10 is provided with a pedestal base 12 including a frame 14 to which a plurality of wheels 16 are connected. A lower inner column 18 extends upwardly from frame 14.

Table 10 is provided with a bracket 20 on its underside. An upper outer column 22 is connected at its upper end to bracket 20, and is slidably mounted to lower column 18 so as to be telescopically movable relative thereto. A release lever 24 is interconnected with bracket 20 for fixing the position of table 10 at a desired elevation, as will be explained.

Figure 2:
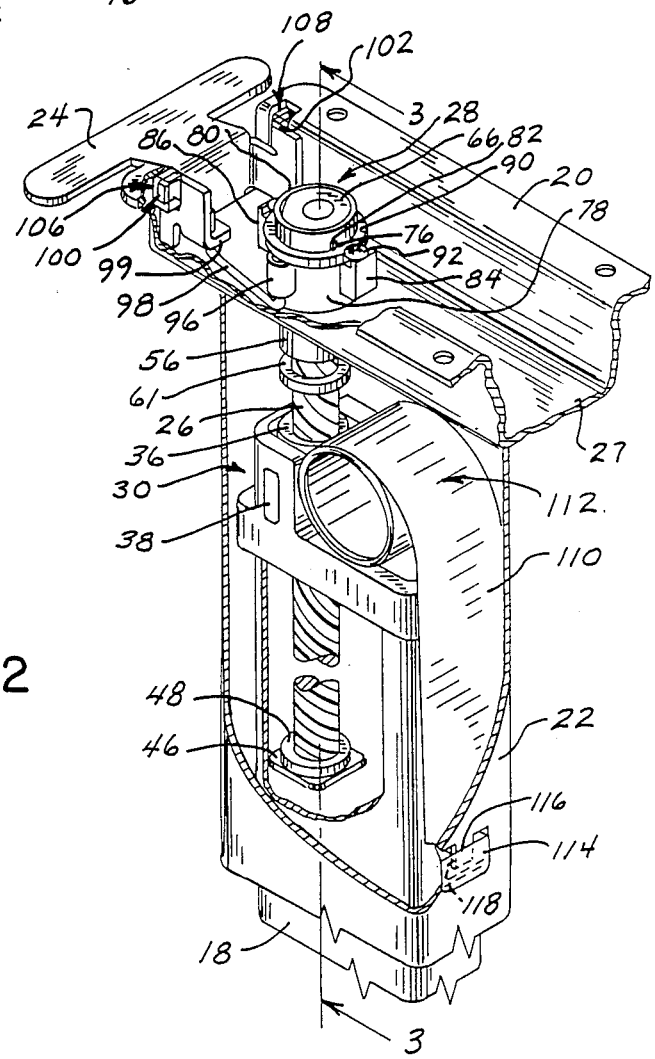
FIG. 2 is an isometric view, with portions broken away, showing the positioning mechanism of the invention.

With reference to FIG. 2, it is seen that a lead screw 26 is rotatably mounted to the bottom wall 27 of bracket 20. Being mounted to bracket 20, lead screw 26 remains in a constant fixed position relative to upper outer column 22. Lead screw 26 is a high lead screw threaded with a one-half inch 10 start acme thread which produces a thread helix angle of approximately 45°. A clutch mechanism, shown generally at 28, is interconnected with the upper end of lead screw 26.

Figure 3:
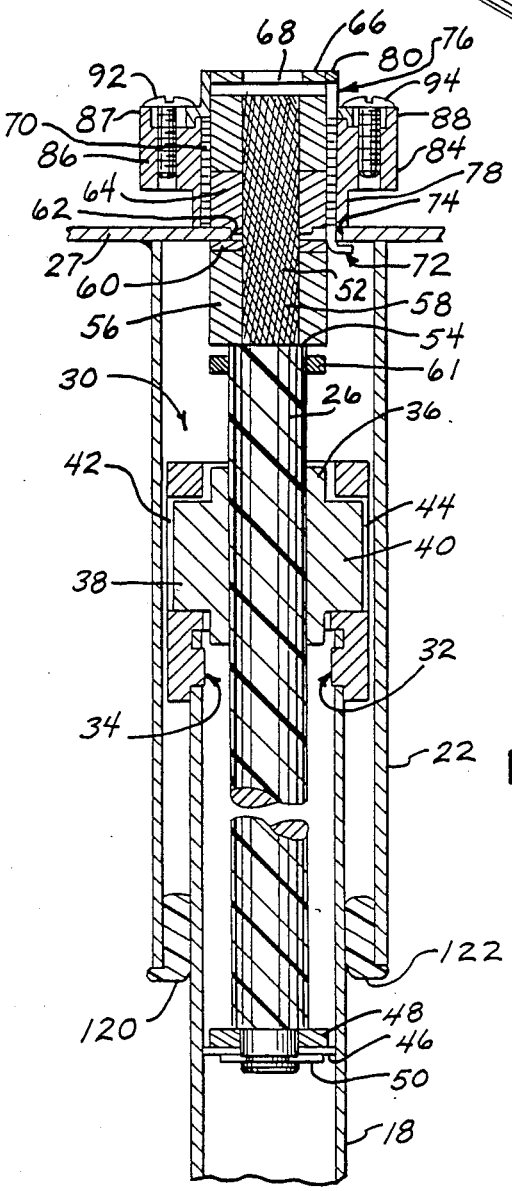
FIG. 3 is a sectional view taken generally along line 3—3 of FIG. 2.

The upper end of lower column 18 is provided with an upper glide member, shown at 30. With reference to FIG. 3, it is seen that upper glide 30 is provided with a pair of inwardly extending projections 32, 34 which mate with openings provided in the upper end of lower column 18. In this manner, upper glide 30 is rigidly secured to the upper end of lower column 18. Upper glide member 30 is constructed of a nylon material which ensures smooth movement of upper column 22 on lower column 18.

A threaded nut 36 is fixed to upper glide 30, and has internal threads which mate with the external threads of lead screw 26. Nut 36 is provided with a pair of outwardly extending ears 38, 40, which mate with a pair of openings 42, 44 formed in upper glide 30. Engagement of ears 38, 40 with openings 42, 44, secures nut 36 to lower column 18 so as to maintain nut 36 stationary. This construction allows nut 36 to float into position as necessary to accommodate manufacturing tolerances, while preventing nut 36 from rotating. With the described construction, upward and downward movement of upper column 22 relative to lower column 18 causes lead screw 26 to rotate, due its engagement with nut 36.

The lower end of lead screw 26 is provided with a glide 46 which engages an inner wall of lower column 18. A rubber washer 48 is provided above glide 46 to absorb impact with the bottom of nut 36 upon raising of table 10 to its full height. A snap ring 50 (FIG. 3) secures glide 46 and washer 48 to the lower end of lead screw 26.

With reference to FIG. 3, it is seen that the upper end of lead screw 26 is provided with a portion of reduced diameter, denoted at 52, so as to form a shoulder 54. A thrust bushing 56 is interference fit onto reduced portion 52 of lead screw 26 so as to engage shoulder 54. Thrust bushing 56 is positioned over a knurled portion 58 provided on reduced portion 52. A nylon thrust washer 60 rests on thrust bushing 56 adjacent the bottom of lower bracket wall 27. A rubber washer 61 is provided at the upper end of lead screw 26 to absorb impact with the top of nut 36 upon lowering table 10 to its lowermost position.

Reduced portion 52 of lead screw 26 extends through an opening 62 provided in lower bracket wall 27. Opening 62 is preferably square, but may be any satisfactory non-circular shape. Clutch mechanism 28 includes a lower clutch sleeve 64, which has a depending projection adapted to mate with opening 62. The engagement of the depending portion of lower clutch sleeve 64 with opening 62 prevents rotation of clutch sleeve 64, and fixes sleeve 64 to bracket 20. Reduced lead screw portion 52 extends through the inner passage through lower clutch sleeve 64, which has an internal diameter larger than the external diameter of reduced portion 52 so as to allow lead screw 26 to freely rotate therein.

An upper clutch sleeve 66 is fixed to the upper end of reduced lead screw portion 52 by means of a pin 68 or the like. In this manner, upper clutch sleeve 66 is engaged with and rotates simultaneously with lead screw 26. As shown, upper and lower clutch sleeves 64, 66 have a substantially identical outside diameter.

Figure 4:
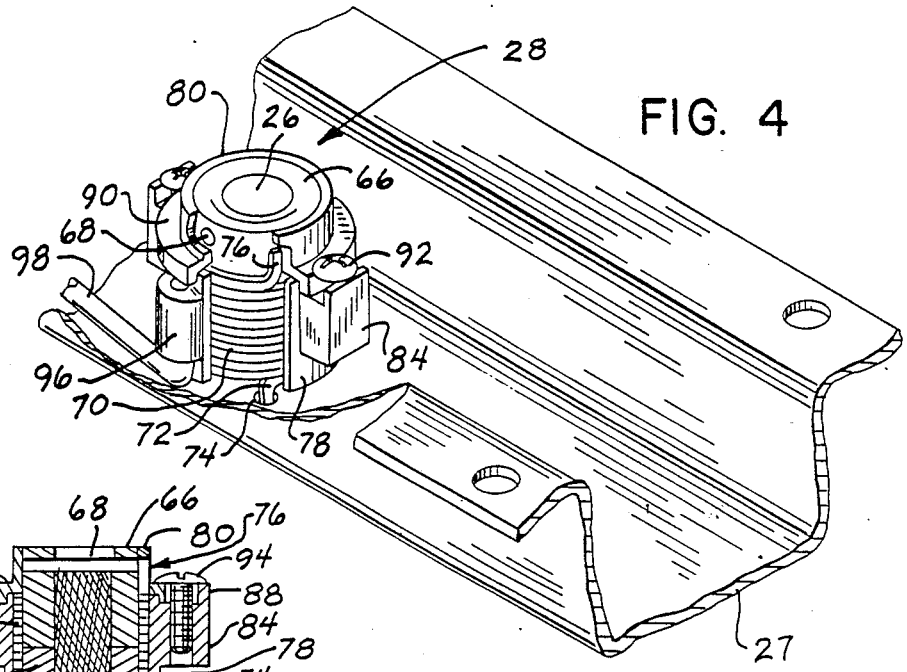
FIG. 4 is an isometric view showing details of the clutch mechanism of the invention.

Clutch mechanism 28 further includes a clutch coil spring 70 (FIGS. 3 and 4), which is wrapped around upper and lower clutch sleeves 64, 66. Spring 70 is constructed so that, in its free state, the internal diameter of spring 70 is approximately 5% less than the outside diameter of upper and lower clutch sleeves 64, 66. In this manner, spring 70 must be physically wrapped onto the clutch sleeves. Spring 70 has a lower tang 72 which engages an opening 74 formed in lower wall 27 of bracket 20, thus fixing the lower end of spring 70 to bracket 20. Spring 70 is further provided with an upper tang 76. As will be explained, the function of coil spring 70 is to selectively couple upper and lower clutch sleeves 64, 66 together to prevent downward movement of table top 10 by preventing rotation of lead screw 26 within nut 36. Upon decoupling of upper and lower sleeves 64, 66, rotation of lead screw 26 caused by downward movement of table top 10 is allowed.

As a means for selectively coupling upper and lower clutch sleeves 64, 66, a lower outer sleeve 78 and an upper outer sleeve 80 are provided about the outer periphery of spring 70. Upper outer sleeve 80 is provided with a slot 82 which receives upper tang 76 of spring 70.

Lower outer sleeve 78 is provided with a pair of bosses 84, 86, each of which has a threaded passage therethrough. Bosses 84, 86 have outer upstanding lips 87, 88, respectively, extending therefrom, and upper outer sleeve 80 is provided with a lower peripheral lip 90. As shown in FIG. 3, the threaded shanks of a pair of fasteners 92, 94 are adapted to engage the threaded openings in lower bosses 84, 86. The heads of fasteners 92, 94 span between and engage lower peripheral lip 90 of upper outer sleeve 80 and lower sleeve upstanding lips 87, 88, respectively. In this manner, upper outer sleeve 80 is movable relative to lower outer sleeve 78 so that upper sleeve 80 can be positioned with slot 82 receiving spring upper tang 76. After such positioning, fasteners 92, 94 are tightened down so as to couple upper and lower outer sleeves 78, 80 together.

Lower outer sleeve 78 further includes a boss 96 (FIG. 2) which has a passage therethrough adapted to receive one end of a link 98. Link 98 is connected at its other end to an opening formed in a tab 99 provided on release lever 24.

With further reference to FIG. 2, release lever 24 is pivotably mounted to lower bracket wall 27 by means of a depending tab which engages a slot formed in lower bracket wall 27. Lever 24 is further provided with a pair of projecting ears 100, 102 which are adapted to be received within a pair of slots, one of which is shown at 104 (FIG. 2), formed in the side walls of bracket 20. Each ear 100, 102 is fitted with a transparent resilient sleeve 106, 108. With this construction, ears 100, 102 are allowed to rock within the slots in the side walls of bracket 20 when lever 24 is lifted. Such movement of lever 24 is transferred through link 98 to rotation of upper and lower outer sleeves 78, 80. Due to the engagement of lower spring tang 72 with lower bracket wall 27, such rotation of upper outer sleeve 80 causes movement of upper tang 76 of spring 70 so as to expand spring 70.

In operation, a person lowers the vertical position of table 10 by raising release lever 24, which causes spring 70 to expand as described. Upon such expansion of spring 70, upper and lower clutch sleeves 64, 66 are decoupled. In this condition, rotation of lead screw 26 is allowed, and table 10 may be lowered. When the desired elevation of table 10 is reached, release lever 24 is released and spring 70 returns to its unexpanded condition. Thereafter, application of a slight downward force to table 10 causes lead screw 26 to rotate a slight amount. The friction between spring 70 and upper clutch sleeve 66 causes spring 70 to be wrapped down around both upper and lower clutch sleeves 64, 66, resulting in greater friction which locks upper and lower clutch sleeves 64, 66 together. Rotation of lead screw 26 is thereby prevented. Table 10 is then supported at the desired elevation until spring 70 is again expanded by lifting of release lever 24.

The described construction provides highly satisfactory "one way" operation of an overbed table. That is, release lever 24 need only be operated when it is desired to lower the elevation of table top 10. An upward force exerted on table top 10 results in rotation of upper clutch sleeve 66 in a direction which tends to expand spring 70, thereby decoupling upper and lower clutch sleeves 64, 66. Lead screw 26 is thus allowed to rotate within nut 36, allowing upward movement of table top 10 without operation of lever 24. When the desired elevation of table top 10 is reached, a slight downward force thereon couples upper and lower clutch sleeves 64, 66 together through spring 70, preventing further downward movement.

To facilitate raising and lowering of table 10, a portion of the weight of table 10 and upper column 22 is supported by a constant force spring 110. Spring 110 includes a curled portion 112 at its upper end which engages upper glide 30. The lower end of spring 110 is formed so as to protrude through an opening 114 formed in a side wall of upper column 22. The lower end of spring 110 is provided with a slot 116 which engages a depending tab 118 formed in the side wall of upper column 22.

With reference to FIG. 3, a pair of lower glides 120, 122 are provided at the lower end of upper column 22. Glides 120, 122 engage the outer surface of lower column 18 to provide accurate positioning of upper column 22 thereover and smooth movement of upper column 22.

While the invention has been described with reference to an overbed table, it is to be understood that the invention may be satisfactorily employed in any application in which it is necessary or desirable to selectively fix the position of a first member relative to a second member.

Various alternatives and modifications are contemplated as being within the scope of the following claims particularly pointing out and distinctly claiming the invention.

I claim:

1. An apparatus, comprising:

a first member;

a second member;

said first and second members being mounted for relative movement therebetween in either a first or a second linear direction; and a mechanism for selectively fixing the relative position of said first and second members, comprising:

a first threaded member interconnected with one of said first or second members;

a second threaded member threadedly engageable with said first threaded member and interconnected with the other of said first or second members;

said first threaded member and said second threaded member being interconnected with said first and second members so that movement of said first or second member relative to the other said member causes relative movement and rotation between said first threaded member and said second threaded member; and selectively engageable clutch means associated with one of said first or second threaded members for selectively allowing relative movement between said first and second members in either of said first or second linear directions by selectively allowing relative movement between said first threaded member and said second threaded member, wherein said selectively engageable clutch means includes means for providing relative movement between said first and second members in only one of said linear directions without actuation thereof by allowing relative rotational movement between said first and second threaded members during such relative movement between said first and second members.

2. The apparatus of claim 1, wherein one of said members comprises a high lead screw having a thread angle sufficient to cause relative movement between said high lead screw and said second threaded member as a result of relative movement between said first and second members.

3. The apparatus of claim 2, wherein one of said first or second members comprises a stationary member, and wherein the other of said first or second member comprises a movable member movable relative to said stationary member.

4. The apparatus of claim 3, wherein said high lead screw is rotatably maintained in a constant position relative to said movable member and said second threaded member comprises a threaded nut fixed to said stationary member, and wherein said clutch means is selectively engageable with said rotatable high lead screw so as to selectively prevent its rotation and thereby selectively prevent relative movement between said high lead screw and said threaded nut when a force is applied to said movable member in a second linear direction, and thereby simultaneously selectively prevent relative movement between said first and second members, and wherein a force applied to said moveable member in said first linear direction causes rotation of said high lead screw in a direction tending to disengage said clutch means from said high lead screw so as to allow relative movement between said first and second members.

5. The apparatus of claim 4, wherein said threaded nut is fixed to said stationary member by means of a pair of projecting ears provided on said threaded nut, said ears engaging a pair of slots provided on said stationary member for preventing rotation of said threaded nut.

6. The apparatus of claim 4, wherein said clutch means comprises a spring clutch mechanism incorporating a resilient spring wrapped around and selectively engageable with said high lead screw.

7. The apparatus of claim 6, wherein said spring clutch mechanism comprises:

a first clutch member fixed to said movable member and through which said high lead screw extends;

a second clutch member fixed to and movable with said high lead screw;

wherein said resilient spring is provided adjacent the outer surfaces of said first and second clutch members; and further comprising selective engagement means for selectively engaging said second clutch member with said first clutch member by simultaneously causing said resilient spring to engage the outer surfaces of said first and second clutch members and thereby selectively prevent rotation of said second clutch member and said high lead screw when a force is applied to said movable member in said second linear direction, and wherein application of a force to said movable member in said first linear direction causes said spring to disengage the outer surfaces of said first and second clutch members for allowing relative movement between said first and second members.

8. The apparatus of claim 7, wherein said first and second clutch members comprise a pair of adjacent substantially cylindrical sleeves.

9. The apparatus of claim 7, wherein said spring has a fixed end engaged with said movable member, and wherein said selective engagement means selectively acts on the free end of said spring to selectively reduce and increase the inside dimension of said spring for selectively simultaneously causing said spring to engage the outer surfaces of said first and second clutch members.

10. The apparatus of claim 9, wherein said selective engagement means comprises a selectively rotatable outer sleeve placed over said spring and engaging said free end of said spring for selectively reducing and increasing the inside dimension of said spring.

11. A support assembly for an overbed table or the like, comprising:

a lower inner pedestal column;

an upper outer column positioned over said lower inner column, said upper column being movable in an up-down direction on said lower inner column;

a rotatably mounted threaded member provided within one of said columns and having its position fixed relative thereto;

a fixed threaded member provided within the other of said columns and engageable with said rotatably mounted threaded member;

said threaded members being interconnected with said upper and lower columns such that up-down movement of said upper column on said lower column causes relative rotational movement between said threaded members; and selectively engageable clutch means for selectively preventing and allowing relative rotational movement between said threaded members and thereby selectively fixing the position of said upper column in said up-down direction relative to said lower column, wherein said selectively engageable clutch means includes means for providing upward movement of said upper column without actuation thereof by allowing relative rotational movement between said threaded members during upward movement of said upper column on said lower column.

12. The support assembly of claim 11, wherein said rotatably mounted threaded member comprises a high lead screw provided within said upper column and having its position fixed relative thereto, and said fixed threaded member comprises a threaded nut engageable with said high lead screw and provided within and fixed to said lower column.

13. The support assembly of claim 12, wherein said threaded nut is provided at the upper end of said lower column.

14. The support assembly of claim 12, wherein said threaded nut is provided with a pair of projecting ears which engage a pair of slots provided in said lower column.

15. The support assembly of claim 12, wherein said high lead screw is rotatably mounted at the upper end of said upper column.

16. The support assembly of claim 15, further comprising a bracket adapted for connection to the underside of said table or the like, and wherein the upper end of said high lead screw is rotatably mounted to said bracket and said clutch means is housed within said bracket.

17. The support assembly of claim 15, wherein said selectively engageable clutch means comprises:

a first clutch member fixed to said upper column and through which a portion of said high lead screw extends;

a second clutch member fixed to and rotatable with said high lead screw; and selective engagement means for selectively coupling said first and second clutch members together for selectively preventing rotation of said high lead screw and thereby movement of said upper column on said lower column when a downward force is applied to said upper outer column.

18. The support assembly of claim 17, wherein said first clutch member comprises a substantially cylindrical sleeve fixed to said upper column, and said second clutch member comprises a substantially cylindrical sleeve adjacent said first sleeve and fixed to said high lead screw.

19. The support assembly of claim 18, wherein said selective engagement means includes a coil spring having its inner surfaces adjacent the outer surfaces of said first and second clutch sleeves, said coil spring being constructed so that it normally tends to couple said first and second clutch sleeves together by simultaneously engaging the outer surfaces of said first and second sleeves, said selective engagement means further including release means for selectively moving said coil spring to a release position for decoupling said first and second clutch sleeves by expanding said coil spring so as to move the inner surfaces of said coil spring out of engagement with the outer surfaces of said first and second clutch sleeves, and wherein upward movement of said upper outer column causes rotation of said high lead screw and said sleeve fixed thereto in a direction tending to expand said coil spring so as to allow upward movement of said upper outer column without actuation of said clutch mechanism.

20. The support assembly of claim 19, wherein said spring has one end fixed to a stationary member, and wherein said release means acts on the free end of said coil spring for selectively expanding said coil spring.

21. The support assembly of claim 20, wherein said coil spring is biased toward its normal position in which it tends to couple said first and second clutch members together, and wherein said release means comprises a rotatably mounted outer sleeve positioned over said coil spring, said outer sleeve engaging the free end of said coil spring so that rotation of said outer sleeve in a first rotational direction expands said coil spring to decouple said first and second clutch members, and rotation of said outer sleeve in the other rotational direction allows said coil spring to return to its normal position to tend to couple said first and second clutch members together.

22. The support assembly of claim 21, wherein said outer sleeve is interconnected with a pivotable release lever interconnected with said upper column for selectively disengaging said first and second clutch members when it is desired to raise or lower said upper outer column.

23. The support assembly of claim 11, further comprising bias means disposed between said upper and lower columns for biasing said upper outer column toward a raised position.

24. The support assembly of claim 23, wherein said bias means comprises a curled spring member having an end engaged with said upper column and its curled portion bearing against the upper end of said lower column.

25. An apparatus, comprising:

a first member;

a second member;

said first and second members being mounted for relative movement therebetween; and a mechanism for selectively fixing the relative position of said first and second members, comprising:

a first threaded member interconnected with one of said first or second members;

a second threaded member threadedly engageable with said first threaded member and interconnected with the other of said first or second members;

said first threaded member and said second threaded member being interconnected with said first and second members so that movement of said first or second member relative to the other said member causes relative movement and rotation between said first threaded member and said second threaded member; and selectively engageable clutch means associated with one of said first or second threaded members for selectively allowing relative movement between said first and second members by selectively allowing relative movement between said first threaded member and said second threaded member;

wherein said first said second threaded members are mounted to said first and second members such that the rotation between said first and second threaded members caused by relative movement between said first and second members is about an axis of rotation oriented substantially parallel to the direction of relative movement between said first and second members.

26. A support assembly for an overbed table or the like, comprising:

a lower inner pedestal column;

an upper outer column positioned over said lower inner column, said upper column being movable in an up-down direction on said lower inner column;

a rotatably mounted threaded member provided within one of said columns and having its position fixed relative thereto;

a fixed threaded member provided within the other of said columns and engageable with said rotatably mounted threaded member;

said threaded members being interconnected with said upper and lower columns such that up-down movement of said upper column on said lower column causes relative rotational movement between said threaded members; and selectively engageable clutch means for selectively preventing and allowing relative rotational movement between said threaded members and thereby selectively fixing the position of said upper column relative to said lower column;

wherein said threaded members are mounted to said upper and lower columns such that the rotational movement between said threaded members caused by movement of said upper column on said lower column is about an axis of rotation oriented substantially parallel to the direction of movement of said upper column on said lower column.

* * * * *